United States Patent [19]

Engström et al.

[11] Patent Number: 4,964,909

[45] Date of Patent: Oct. 23, 1990

[54] HEAT-INSULATING COMPONENT AND A METHOD OF MAKING SAME

[75] Inventors: Ulf Engström; Olavi Mustonen, both of Höganäs, Sweden

[73] Assignee: Hoganas AB, Hoganas, Sweden

[21] Appl. No.: 304,513

[22] PCT Filed: Jun. 24, 1987

[86] PCT No.: PCT/SE87/00292

§ 371 Date: Jan. 4, 1989

§ 102(e) Date: Jan. 4, 1989

[87] PCT Pub. No.: WO88/00102

PCT Pub. Date: Jan. 14, 1988

[30] Foreign Application Priority Data

Jul. 4, 1986 [SE] Sweden ..... 8602994

[51] Int. Cl.[5] ..... B22F 9/00

[52] U.S. Cl. ..... 75/246; 419/2; 419/38

[58] Field of Search ..... 419/2, 38; 75/246

[56] References Cited

U.S. PATENT DOCUMENTS

| | | | |
|---|---|---|---|
| 3,980,444 | 9/1976 | Reen | 29/182 |
| 3,993,445 | 11/1976 | Reen | 29/182.5 |
| 4,494,988 | 1/1985 | Schumacher et al. | 75/128 |

FOREIGN PATENT DOCUMENTS

| | | |
|---|---|---|
| 361424 | 11/1971 | European Pat. Off. . |
| 0097737 | 5/1982 | European Pat. Off. . |
| 1928930 | 11/1970 | Fed. Rep. of Germany . |
| 2122977 | 11/1972 | Fed. Rep. of Germany . |
| 609689 | 3/1946 | United Kingdom . |

*Primary Examiner*—Stephen J. Lechert, Jr.
*Assistant Examiner*—Leon Nigohosian, Jr.
*Attorney, Agent, or Firm*—Browdy and Neimark

[57] ABSTRACT

A heat-insulating component consists of a porous body obtained by moulding and sintering an iron-base powder having an admixture of 2–10% by weight of silicon, preferably 4–8% by weight. A method of making the heat-insulating component includes the steps of preparing an iron-base powder mixture with an admixture of 2–10% by weight of silicon, preferably 4–8% by weight; optionally supplying the powder with further admixtures in the form of 3–12% by weight of maganese, preferably 5–10% by weight, up to 25% by weight of chromium, up to 15% by weight of nickel, up to 2.5 % by weight of molybdenum and up to 2% by weight of carbon, moulding the powder mixture into a body of desired shape, and sintering the body for obtaining a porous component having a coefficient of thermal conductivity below about 12 W/m°K, preferably below 7 W/m°K.

11 Claims, No Drawings

HEAT-INSULATING COMPONENT AND A METHOD OF MAKING SAME

The present invention relates to a heat-insulating component and a method of making same. The invention also relates to a method of lowering the thermal conductivity of a component obtained from an iron-base powder mixture by moulding and sintering.

Substantial efforts have been made over the years to develop ceramic materials which are suitable for use in internal combustion engines. Although these efforts have met with some success, the ceramic materials, by being relatively brittle, have however caused a number of problems reducing their usefulness. Also, difficulties in durably joining the ceramic material to metal are encountered since the materials used normally have different coefficients of heat expansion. Similarly, the ceramic materials are difficult or impossible to use if after-treatment is necessitated by shape or demands on tolerance.

The need of being able to prevent heat from being conducted out to the engine block of an internal combustion engine has increased with the demand for exhaust emission control, like the demand for an increase of the efficiency of a diesel engine, e.g. by controlling the thermal losses.

The object of the invention therefore is to develop a product having a low thermal conductivity, more specifically a coefficient of thermal conductivity below about 12 W/m°K, and most preferably below about 7 W/m°K, in combination with toughness, strength, machinability, freedom of choice in respect of manufacturing method, and a coefficient of heat expansion allowing joining the product to metal in a simple and durable manner. It has been found quite surprisingly that this is feasible starting from a metallic powder.

It is not to be expected that metals without the addition of oriented ceramic flakes may be used for heat-insulating purposes. From British patent specification GB-2,124,658 it is thus known to use 10–30% by weight of oriented ceramic flakes in a stainless alloy for manufacturing brake components with directional heat transmission.

By adding silicon and possibly manganese to a powder or to a melt for atomization, consisting of pure iron or iron-nickel, and thereafter manufacturing porous sintered bodies, it was however found that it was possible to adjust the heat-insulating properties to values equivalent to those obtained with zirconium oxide.

Silicon strongly affects the thermal conductivity and the amount of silicon should be between 2 and 10% by weight and preferably between 4 and 8% by weight. If the amount of silicon becomes excessive, the liquid phase also becomes excessive, entailing that the powder body will collapse upon sintering and the porosity will decrease dramatically.

The addition of manganese primarily affects the workability of the sintered body but also, to some extent, the thermal conductivity. It has been found that if manganese is to be added, the amount should be between 3 and 12% by weight and preferably between 5 and 10% by weight.

If there is a demand for high corrosion resistance, chromium may also be added. The amount of chromium must not exceed 25% by weight since with larger amounts, a compact will not hold together after compaction. A chromium amount of about 21% has been particularly suitable.

For increased strength of the sintered body, nickel may be added in an amount of up to 15% by weight.

Also other alloying materials, such as molybdenum and carbon, may be added without noticeably deteriorating the inventive effect.

Powder mixtures may be preferable, giving increased flexibility in the choice of alloying additives and are sometime necessary for achieving the required compressibility. For certain components and methods of manufacture, it has however been found more appropriate to use prealloyed atomized powder.

To sum up, the present invention requires no ceramic flakes or in any way oriented particles, but the excellent heat-insulating properties are achieved by producing thermal barriers by structural transition, primarily by means of silicon but also by means of manganese. This entails e.g. that the components according to the invention, as opposed to those disclosed in GB-2,124,658, can be manufactured by all techniques currently used within the powder metallurgy, with or without additives for pore formation in dependence upon the desired insulating capacity and the required accuracy of the finished component.

The invention will now be exemplified in more detail in the non-limitative Examples given below.

EXAMPLE 1

Three metal powders A, B and C of the following compositions were prepared.

A: 100.0% pure iron powder

B: 97.5% Fe+2.5% Si

C: 90.0% Fe+7.5% Mn +2.5% Si

From these three powders, specimens were compacted at a compacting pressure of 400 MPa. The specimens were sintered at 1250° C. for 1 h in hydrogen gas atmosphere.

Since the thermal conductivity is directly dependent on the porosity of the material, the compacting pressure was so adjusted that the specimens of the three different powders all had a porosity of 25% by volume after sintering.

The coefficient of thermal conductivity was then determined and the following results were obtained.

| Material | Coefficient of thermal conductivity (W/m °K.) |
|---|---|
| A | 30.0 |
| B | 10.0 |
| C | 7.5 |

EXAMPLE 2

Four metal powders D, E, F and G of the following compositions were prepared.

D: 85%Fe+15% Cr

E: 80%Fe+15% Cr +5% Si

F: 75% Fe+15% Cr+5% Si +5% Mn

G: 70% Fe+15% Cr+5% Si +10% Ni +0.8% C

As in Example 1, specimens were manufactured having a porosity of 25% by volume after sintering.

The coefficient of thermal conductivity for the different materials was determined as well as the coefficient of heat expansion and tensile strength ($R_m$), giving the following results.

| Material | Coefficient of thermal conductivity (W/m °K.) | Coefficient of heat expansion (m/m °C. × $10^{-6}$) | Rm (N/mm$^2$) |
|---|---|---|---|
| D | 14.0 | 13.0 | 120 |
| E | 12.1 | 13.2 | 190 |
| F | 6.5 | 14.7 | 240 |
| G | 4.0 | — | 170 |

It appears from the above Table that powder F yields a material in which it has been possible, most surprisingly, to combine a very low thermal conductivity with a coefficient of heat expansion which closely conforms to e.g. cast iron, and a satisfactory mechanical strength.

EXAMPLE 3

Two metal powders H and I of the following compositions were prepared.

H: 70% FE+10% Ni+18% Cr+2% Mo I: 62% Fe+10% Ni+18% Cr+2% Mo+8% Si

As in the earlier Examples, specimens were prepared having a porosity of 25% by volume, whereupon thermal conductivity, coefficient of heat expansion and tensile strength were determined.

| Material | Coefficient of thermal conductivity (W/m °K.) | Coefficient of heat expansion (m/m °C. × $10^{-6}$) | Rm (N/mm$^2$) |
|---|---|---|---|
| H | 7.0 | 22.2 | 120 |
| I | 3.5 | 17.5 | 100 |

These results show that the thermal conductivity, without altering the tensile strength, can be considerably reduced by alloying a stainless powder with silicon or silicon and manganese.

In order to check that the thermal barrier is not adversely affected by different methods of manufacture, specimens according to Examples 1, 2 and 3 were prepared by extrusion, injection moulding and isostatic compacting. After sintering and correction for a slightly varying pore volume, it was found that different methods of manufacture, using Examples 1, 2 and 3, give a fully comparable coefficient of thermal conductivity.

In order to further elucidate the effect of a variation of the amount of silicon, manganese and chromium on the coefficient of thermal conductivity, specimens were prepared as described above on the basis of metal powder with varying amounts of one of these alloying materials.

EXAMPLE 4

Four metal powders J, K, L and M were prepared having a constant amount of manganese and chromium and a varying amount of silicon, as stated below.

J: 80% Fe+10% Mn+10% Cr+0% Si
K: 78% Fe+10% Mn+10% Cr+2% Si
L: 75% Fe+10% Mn+10% Cr+5% Si
M: 70% Fe+10% Mn+10% Cr+10% Si

The thermal conductivity of the specimens manufactured from these mixtures was determined and the following results were obtained.

| Material | Coefficient of thermal conductivity (W/m °K.) |
|---|---|
| J | 15.5 |

-continued

| Material | Coefficient of thermal conductivity (W/m °K.) |
|---|---|
| K | 10.0 |
| L | 7.0 |
| M | — |

Material M exhibited a considerably reduced porosity as a consequence of an excessive liquid phase. Thus, the thermal conductivity decreases considerably with an increasing amount of silicon up to about 10% silicon.

EXAMPLE 5

Four metal powders N, 0, P and Q were prepared having a constant amount of silicon and manganese and a varying amount of chromium, as stated below.

N:80% Fe+5%Si+5% Mn+10% Cr
O:75% Fe+5% Si+5% Mn+15% Cr
P:70% Fe+5% Si+5% Mn+20% CR
Q:65% Fe+5% Si+5% Mn +25% Cr

The thermal conductivity of the specimens manufactured from these mixtures was determined and the following results were obtained.

| Material | Coefficient of thermal conductivity (W/m °K.) |
|---|---|
| N | 8.0 |
| O | 7.2 |
| P | 6.0 |
| Q | — |

Material Q exhibited poor green strength and did not hold together after compacting and, therefore, could not be sintered. A certain minor reduction of the thermal conductivity with an increasing amount of chromium was thus found.

EXAMPLE 6

Three metal powders R, S and T of the following compositions were prepared.

R:80% Fe+5% Si+15% Cr+0% Mn
S:75% Fe+5% Si+15% Cr+5% Mn
T:75% Fe+5% Si+10% Cr +10% Mn

The thermal conductivity of the specimens manufactured from these mixtures was determined and the following results were obtained.

| Material | Coefficient of thermal conductivity (W/m °K.) |
|---|---|
| R | 7.6 |
| S | 6.5 |
| T | 6.0 |

Also in this case, there was a slight reduction of the thermal conductivity with an increasing amount of manganese.

What is claimed is:

1. A heat-insulating component consisting of a porous body obtained by molding and sintering an iron-base powder consisting of an admixture of 2–10% by weight of silicon, an admixture of 5–10% by weight of manganese, an admixture of 10–25% by weight of chromium, an admixture of 0–15% by weight of nickel, an admixture of 0–2.5% by weight of molybdenum and an admixture of 0–2% by weight of carbon.

2. Heat-insulating component as claimed in claim 1, wherein the admixture of silicon is at least 4% by weight.

3. Heat-insulating component as claimed in claim 1, wherein the admixture of silicon is 4–8% by weight.

4. Heat-insulating component as claimed in claim 1, wherein the admixture of chromium is about 21% by weight.

5. A method of making a heat-insulating component, comprising the steps of preparing an iron-base powder mixture with an admixture of 2–10% by weight of silicon, an admixture of 5–10% by weight of manganese, an admixture of 14–25% by weight of chromium, an admixture of 0–15% by weight of nickel, an admixture of 0–2.5% by weight of molybdenum and an admixture of 0–2% by weight of carbon; molding the powder mixture into a body of desired shape, and sintering the body for obtaining a porous component having a coefficient of a thermal conductivity below about 12W/m°K, and a coefficient of heat expansion closely conforming to that of cast iron.

6. Method as claimed in claim 5, wherein the mixture is prepared with an admixture of 4–8% by weight of silicon, and the body is sintered to obtain a porous component having a thermal conductivity below 7 W/m°K.

7. A method of lowering the thermal conductivity of a component obtained from an iron-base powder mixture by molding and sintering, including the step of supplying the powder mixture with an admixture of 2–10% by weight of silicon and 10–21% by weight of chromium.

8. Method as claimed in claim 7, wherein the admixture is 4–8% by weight of silicon.

9. Method as claimed in claim 7, including the step of supplying the powder mixture with a further admixture of one or more elements selected from the group consisting of manganese, nickel, molybdenum and carbon.

10. A heat-insulating, porous body having a coefficient of thermal conductivity below about 12 W/m°K consisting essentially of molded and sintered iron-based powder mixed together with 2–10% by weight silicon, 5–10% by weight manganese, 10–21% by weight chromium, 0–15% nickel, 0–25% molybdenum and 0–2% by weight carbon, said body having a coefficient of heat expansion which closely conforms to iron and has good mechanical strength.

11. A heat-insulating body according to claim 10 wherein said silicon is present in an amount of 4–8% by weight.

* * * * *